US010837644B2

(12) United States Patent
Gattermeyer et al.

(10) Patent No.: US 10,837,644 B2
(45) Date of Patent: Nov. 17, 2020

(54) TOOL KIT AND METHOD FOR DECOUPLING CROSS-FIRE TUBE ASSEMBLIES IN GAS TURBINE ENGINES

(71) Applicant: General Electric Company, Schenectady, NY (US)

(72) Inventors: Todd James Gattermeyer, Hamilton, OH (US); Stuart Craig Hanson, Anderson, SC (US); Brandon Taylor Overby, Spartanburg, SC (US)

(73) Assignee: General Electric Company, Schenectady, NY (US)

( * ) Notice: Subject to any disclaimer, the term of this patent is extended or adjusted under 35 U.S.C. 154(b) by 904 days.

(21) Appl. No.: 15/278,058

(22) Filed: Sep. 28, 2016

(65) Prior Publication Data

US 2018/0085869 A1 Mar. 29, 2018

(51) Int. Cl.

| | |
|---|---|
| ***F23R 3/48*** | (2006.01) |
| ***F01D 9/02*** | (2006.01) |
| ***F01D 25/28*** | (2006.01) |

(52) U.S. Cl.

CPC ..... *F23R 3/48* (2013.01); *F01D 9/023* (2013.01); *F01D 25/285* (2013.01); *F05D 2230/64* (2013.01); *F05D 2230/70* (2013.01); *F05D 2230/72* (2013.01); *F23R 2900/00017* (2013.01); *F23R 2900/00019* (2013.01)

(58) Field of Classification Search

USPC ..... 29/255–282

See application file for complete search history.

(56) References Cited

U.S. PATENT DOCUMENTS

| | | | | |
|---|---|---|---|---|
| 2,741,022 | A | 4/1956 | Weaver | |
| 2,832,195 | A | 4/1958 | Weissborn, Jr. | |
| 5,210,919 | A * | 5/1993 | Garman | B25B 27/023 29/257 |
| 5,440,778 | A | 8/1995 | De Guzman | |
| 7,338,101 | B2 | 3/2008 | Quiroz | |
| 8,220,246 | B2 | 7/2012 | Widener | |
| 9,133,858 | B2 | 9/2015 | Macchia et al. | |

(Continued)

OTHER PUBLICATIONS

Extended European Search Report and Opinion issued in connection with corresponding EP Application No. 17193833.5 dated May 4, 2018.

*Primary Examiner* — Orlando E Aviles
*Assistant Examiner* — Seahee Hong
(74) *Attorney, Agent, or Firm* — James W. Pemrick; Charlotte C. Wilson

(57) ABSTRACT

A tool kit for decoupling a telescoping tube from a first liner of a gas turbine engine is disclosed. The tool kit includes a base plate coupled to a combustor casing. A post extends outward from the base plate into a combustion chamber defined by the liner. A plunger slidably mounts to the post and is slidable between an extended position and a retracted position. A lever arm pivotably couples to the post and the plunger. Pivoting the lever arm in a first direction slides the plunger to the extended position to decouple the telescoping tube from the liner. A retaining clip couples to the combustor casing and extends into an annular plenum at least partially defined between the liner and the combustor casing. The retaining clip defines a notch that receives the telescoping tube after the plunger assembly decouples the telescoping tube from the liner.

20 Claims, 10 Drawing Sheets

(56) References Cited

U.S. PATENT DOCUMENTS

| | | | | |
|---|---|---|---|---|
| 2009/0241313 | A1* | 10/2009 | Vess | B25B 27/04 29/275 |
| 2011/0247193 | A1* | 10/2011 | Herbold | F23R 3/002 29/464 |
| 2012/0304648 | A1* | 12/2012 | Byrne | F23R 3/06 60/737 |
| 2014/0137536 | A1 | 5/2014 | Cloninger et al. | |
| 2015/0052910 | A1 | 2/2015 | Perkins et al. | |
| 2015/0260096 | A1 | 9/2015 | Oden et al. | |

* cited by examiner

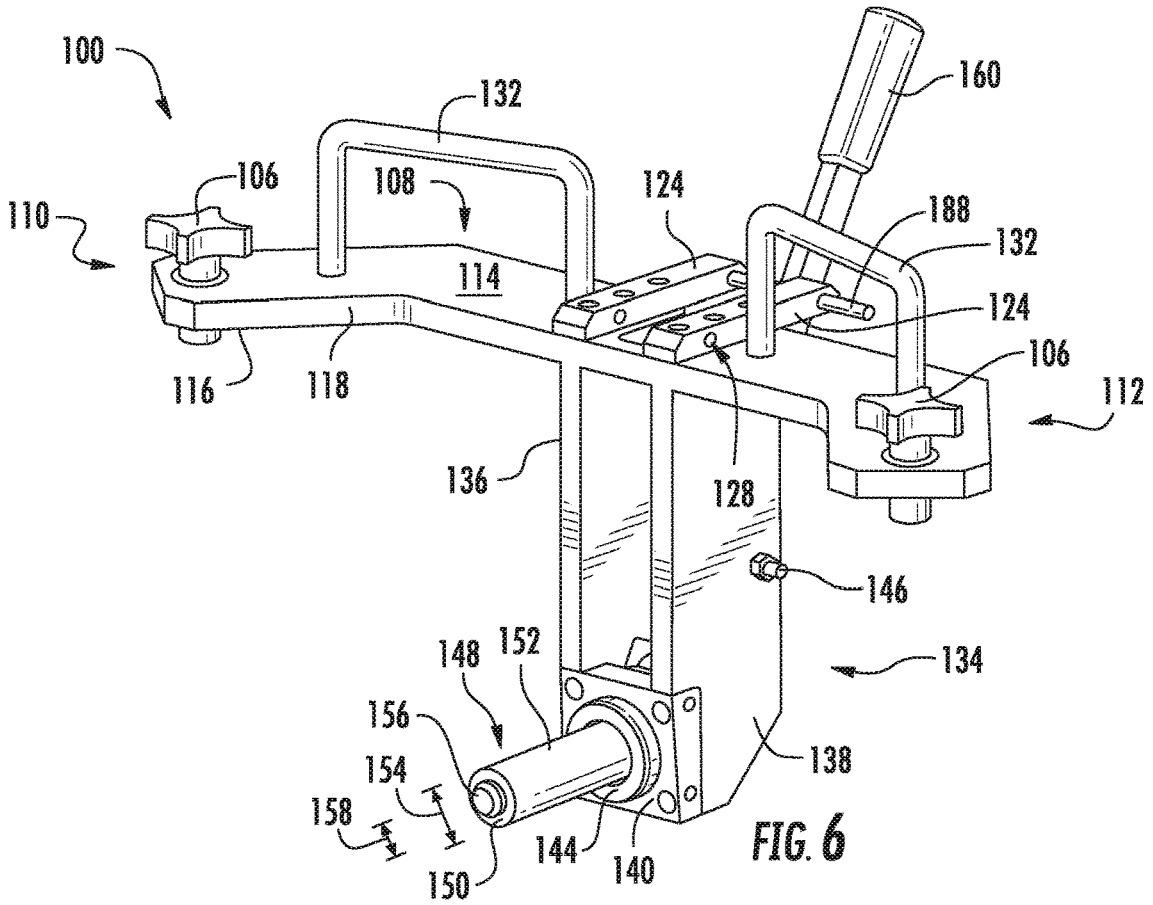
FIG. 6
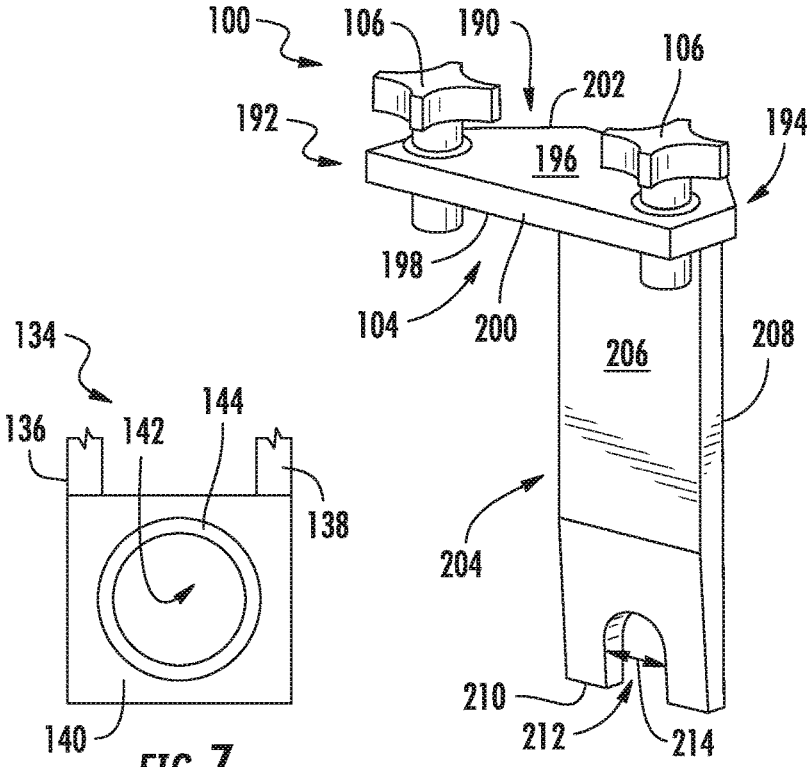
FIG. 9
FIG. 7
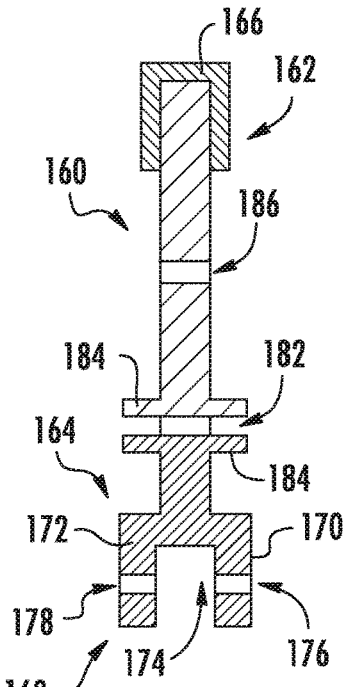
FIG. 8

TOOL KIT AND METHOD FOR DECOUPLING CROSS-FIRE TUBE ASSEMBLIES IN GAS TURBINE ENGINES

FIELD OF THE TECHNOLOGY

The present disclosure generally relates to gas turbine engines. More particularly, the present disclosure relates to tool kits and methods for decoupling cross-fire tube assemblies in gas turbine engines.

BACKGROUND

A gas turbine engine generally includes a compressor section, a combustion section, and a turbine section. The compressor section progressively increases the pressure of the air entering the gas turbine engine and supplies this compressed air to the combustion section. The compressed air and a fuel (e.g., natural gas) mix within the combustion section before burning in one or more combustion chambers to generate high pressure and high temperature combustion gases. The combustion gases flow from the combustion section into the turbine section where they expand to produce mechanical rotational energy. For example, expansion of the combustion gases in the turbine section may rotate a rotor shaft connected, e.g., to a generator to produce electricity.

The combustion section typically includes a plurality of annularly arranged combustors, each of which receives compressed air from the compressor section. Each combustor generally includes a combustor casing, a liner, and a flow sleeve. The combustor casing surrounds the combustor and contains the compressed air received from the compressor section therein. The liner is positioned within the combustor casing and defines at least a portion of the combustion chamber. The flow sleeve circumferentially surrounds at least a portion of the liner. As such, the flow sleeve and the liner collectively define an annular plenum therebetween through which the compressed air may flow before entering the combustion chamber. One or more fuel nozzles supply the fuel to each combustor for mixing with the compressed air therein. This fuel-air mixture flows into the combustion chamber where a spark plug or other ignition device may initiate combustion.

In certain configurations having multiple combustors in the combustion section, only some of the combustors may include the spark plug or other ignition device. In this respect, one or more cross-fire tube assemblies may propagate combustion between different combustion chambers. More specifically, each cross-fire tube assembly fluidly couples the combustion chamber in one combustor with the combustion chamber in an adjacent combustor. Accordingly, combustion in one combustion chamber may travel through the cross-fire tube assembly to ignite the fuel air mixture in an adjacent combustion chamber.

In order to facilitate the aforementioned fluid communication, the cross-fire tube assemblies must connect to the liners defining the combustion chambers. Certain combustor maintenance activities (e.g., replacement of the liner) may require that the cross-fire tube assembly be decoupled from the liner. Nevertheless, conventional tools and methods for decoupling cross-fire tube assemblies may require removal of components from multiple combustors before use thereof.

BRIEF DESCRIPTION OF THE TECHNOLOGY

Aspects and advantages of the technology will be set forth in part in the following description, or may be obvious from the description, or may be learned through practice of the technology.

In one aspect, the present disclosure is directed to a tool kit for decoupling a telescoping tube from a liner of a combustor of a gas turbine engine. The tool kit includes a plunger assembly having a base plate, a post, a plunger, and a lever arm. The base plate couples to a combustor casing. The post extends outward from the base plate into a combustion chamber at least partially defined by the liner. The plunger slidably mounts to the post and is slidable between an extended position and a retracted position. The lever arm pivotably couples to the post and to the plunger. Pivoting the lever arm in a first direction slides the plunger to the extended position to decouple the telescoping tube from the liner. A retaining clip couples to the combustor casing and extends into an annular plenum at least partially defined between the liner and the combustor casing. The retaining clip defines a notch that receives the telescoping tube after the plunger assembly decouples the telescoping tube from the liner.

Another aspect of the present disclosure is directed to a system for decoupling a telescoping tube from a liner of a gas turbine engine. The system includes a liner that at least partially defines a combustion chamber. A combustor casing surrounds at least a portion of the liner and is spaced apart from the liner. The combustor casing and the liner at least partially define an annular plenum therebetween. A telescoping tube extends through the combustor casing and couples to the liner. A plunger assembly includes a base plate, a post, a plunger, and a lever arm. The base plate couples to the combustor casing. The post extends outward from the base plate into the combustion chamber. The plunger is positioned in the combustion chamber and slidably mounts to the post. The plunger aligns with the telescoping tube and is slidable between an extended position and a retracted position. The lever arm pivotably couples to the post and to the plunger. Pivoting the lever arm in a first direction slides the plunger into contact with the telescoping tube and into the extended position to decouple the telescoping tube from the liner. A retaining clip couples to the combustor casing and extends into the annular plenum. The retaining clip defines a notch that receives the telescoping tube after the plunger assembly decouples the telescoping tube from the liner.

A further aspect of the present disclosure is directed to a method for decoupling a telescoping tube from a liner of a combustor of a gas turbine engine. The method includes inserting a plunger assembly partially into a combustion chamber defined by the liner. The plunger assembly includes a base plate, a post extending outward from the base plate into the combustion chamber, a plunger slidably mounted to the post and aligned with the telescoping tube, and a lever arm pivotably coupled to the post and to the plunger. The base plate is coupled to the combustor casing. The lever arm is pivoted in a first direction to slide the plunger into contact with the telescoping tube and into an extended position to decouple the telescoping tube from the liner. The lever arm is locked after the plunger is in the extended position. A retaining clip is inserted into an annular plenum defined between the liner and the combustor casing such that a notch defined by the retaining clip receives the telescoping tube to retain the telescoping tube in a decoupled position. The retaining clip is coupled to the combustor casing.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which:

FIG. 6 is a front perspective view of the plunger assembly similar to FIG. 4, illustrating a plunger in an extended position;

FIG. 7 is an enlarged front view of a post of the plunger assembly, illustrating a bushing plate;

FIG. 8 is a cross-sectional view of a lever arm of the plunger assembly, illustrating the various features thereof;

FIG. 9 is a perspective view of a retaining clip, which may be part of the tool kit for decoupling the telescoping tube in accordance with the embodiments disclosed herein;

Figure 1:
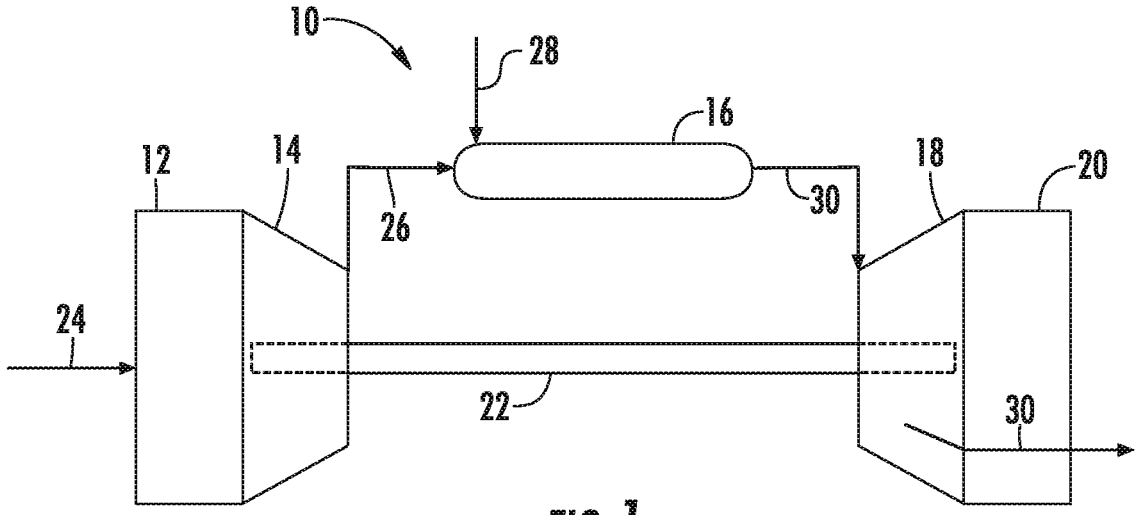
FIG. 1 is a functional block diagram of an exemplary gas turbine engine that may incorporate various embodiments of the present disclosure.

Repeat use of reference characters in the present specification and drawings is intended to represent the same or analogous features or elements of the present technology.

DETAILED DESCRIPTION OF THE TECHNOLOGY

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents. Although an industrial or land-based gas turbine is shown and described herein, the present technology as shown and described herein is not limited to a land-based and/or industrial gas turbine unless otherwise specified in the claims. For example, the technology as described herein may be used in any type of turbine including, but not limited to, aviation gas turbines (e.g., turbofans, etc.), steam turbines, and marine gas turbines.

Now referring to the drawings, wherein identical numerals indicate the same elements throughout the figures, FIG. 1 schematically illustrates an exemplary gas turbine engine 10. As depicted therein, the gas turbine engine 10 includes an inlet section 12, a compressor 14, one or more combustors 16, a turbine 18, and an exhaust section 20. The compressor 14 and turbine 18 may be coupled by a shaft 22, which may be a single shaft or a plurality of shaft segments coupled together.

During operation, the gas turbine engine 10 produces mechanical rotational energy, which may, e.g., be used to generate electricity. More specifically, air 24 enters the inlet section 12 of the gas turbine engine 10. In some embodiments, the inlet section 12 may include various filters, cooling coils, moisture separators, and/or other devices to purify and otherwise condition the air 24. From the inlet section 12, the air 24 flows into the compressor 14, where it is progressively compressed to provide compressed air 26 to each of the combustors 16. The compressed air 26 in each of the combustors 16 mixes with a fuel 28. The resulting fuel-air mixture burns in each combustor 16 to produce high temperature and high pressure combustion gases 30. From the combustors 16, the combustion gases 30 flow through the turbine 18, which extracts kinetic and/or thermal energy therefrom. This energy extraction rotates the shaft 22, thereby creating mechanical rotational energy for powering the compressor 14 and/or generating electricity. The combustion gases 30 exit the gas turbine engine 10 through the exhaust section 20. In some embodiments, the exhaust section 20 may include, for example, a heat recovery steam generator (not shown) for cleaning and extracting additional heat from the combustion gases 30 prior to release to the environment.

Some embodiments of the gas turbine engine 10 include multiple combustors 16. In such embodiments, the combustors 16 may be annularly-arranged can-type combustors.

Figure 2:
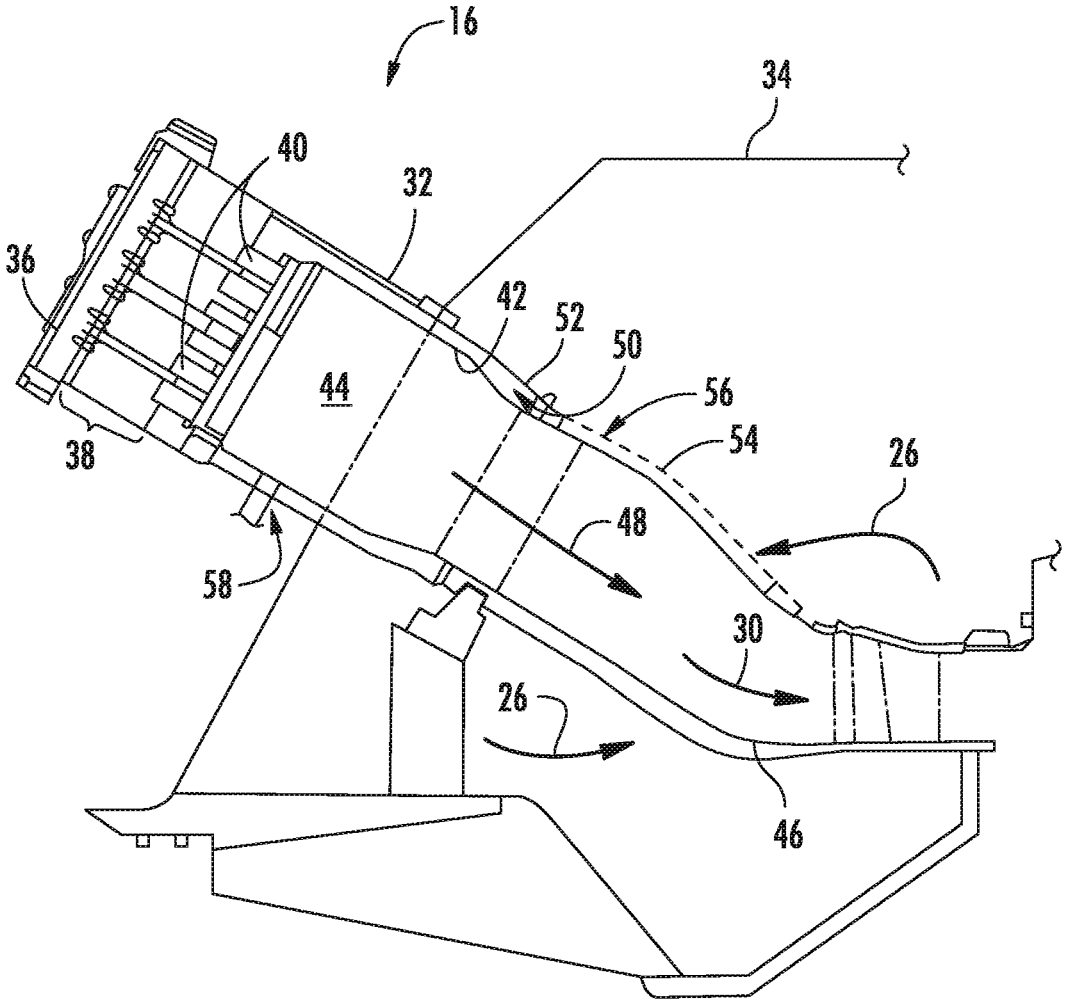
FIG. 2 is a simplified cross-sectional side view of an exemplary combustor that may incorporate various embodiments of the present disclosure.

FIG. 2 illustrates an exemplary embodiment of one of the combustors 16. In the embodiment depicted therein, the combustor 16 is a can-type combustor. More specifically, the combustor 16 includes a combustor casing 32 that couples to a compressor discharge casing 34. The combustor casing 32 circumferentially encloses at least a portion of the combustor 16. As such, the combustor casing 32 and/or the compressor discharge casing 34 contain the compressed air 26 entering the combustor 16 from the compressor 14. The combustor 16 also includes an end cover 36 that couples to the combustor casing 32. As shown in FIG. 2, the combustor casing 32 and end cover 36 collectively define a head end 38 in the combustor 16. One or more fuel nozzles 40 may be arranged in the head end 38 to supply fuel 28, diluent, and/or other additives to a combustion chamber 44 located downstream from the head end 38. A liner 42 positioned downstream of the head end 38 defines the combustion chamber 44 where the fuel-air mixture is burned. A transition duct 46 positioned downstream from the liner 42 couples the combustor 16 to the turbine 18. As such, the liner 42 and the transition duct 46 at least partially define a hot gas path 48 through the combustor 16 for routing the combustion gases 30 to the turbine 18. Although, the combustor 16 may have different configurations in other embodiments.

The embodiment of the combustor 16 shown in FIG. 2 includes an annular plenum 50. More particularly, a flow sleeve 52 may circumferentially surround a portion of the liner 42. Similarly, an impingement sleeve 54 defining one or more flow apertures 56 extending therethrough may circumferentially surround at least a portion of the transition duct 46. In this respect, the liner 42, the transition duct 46, the flow sleeve 52, and impingement sleeve 54 collectively define the annular plenum 50. In the embodiment shown in FIG. 2, the flow sleeve 52 terminates before reaching the head end 38. As such, the liner 42 and the combustor casing 32 define a portion of the annular plenum 50 positioned between the flow sleeve 52 and the head end 38. In operation, the compressed air 26 from the compressor 14 may enter the annular plenum 50 through the one or more flow apertures 56 in the impingement sleeve 54. As the compressed air 26 flows through the annular plenum 50 to the head end 38, it convectively cools the transition duct 46 and the liner 42. Upon reaching the head end 38, the compressed air 26 reverses direction and flows through the fuel nozzles 40 and into the combustion chamber 44.

As shown in FIG. 2, the gas turbine engine 10 includes one or more cross-fire tube assemblies 58. Each of the cross-fire tube assemblies 58 fluidly couples an adjacent pair of the combustors 16 to permit combustion to propagate therebetween. In the embodiment shown in FIG. 3, for example, one of the cross-fire tube assemblies 58 fluidly couples a first combustor 16A and an adjacent second combustor 16B. In this respect, combustion in, e.g., the first combustor 16A may travel through the cross-fire tube assembly 58 to the second combustor 16B. Nevertheless, the combustion may travel through the cross-fire tube assembly 58 from the second combustor 16B to the first combustor 16A as well. As such, every one of the combustors 16 in the gas turbine engine 10 need not have a spark plug or other ignition device (not shown). The gas turbine engine 10 may include as many or as few cross-fire tube assemblies 58 as is necessary or desired.

Figure 3:
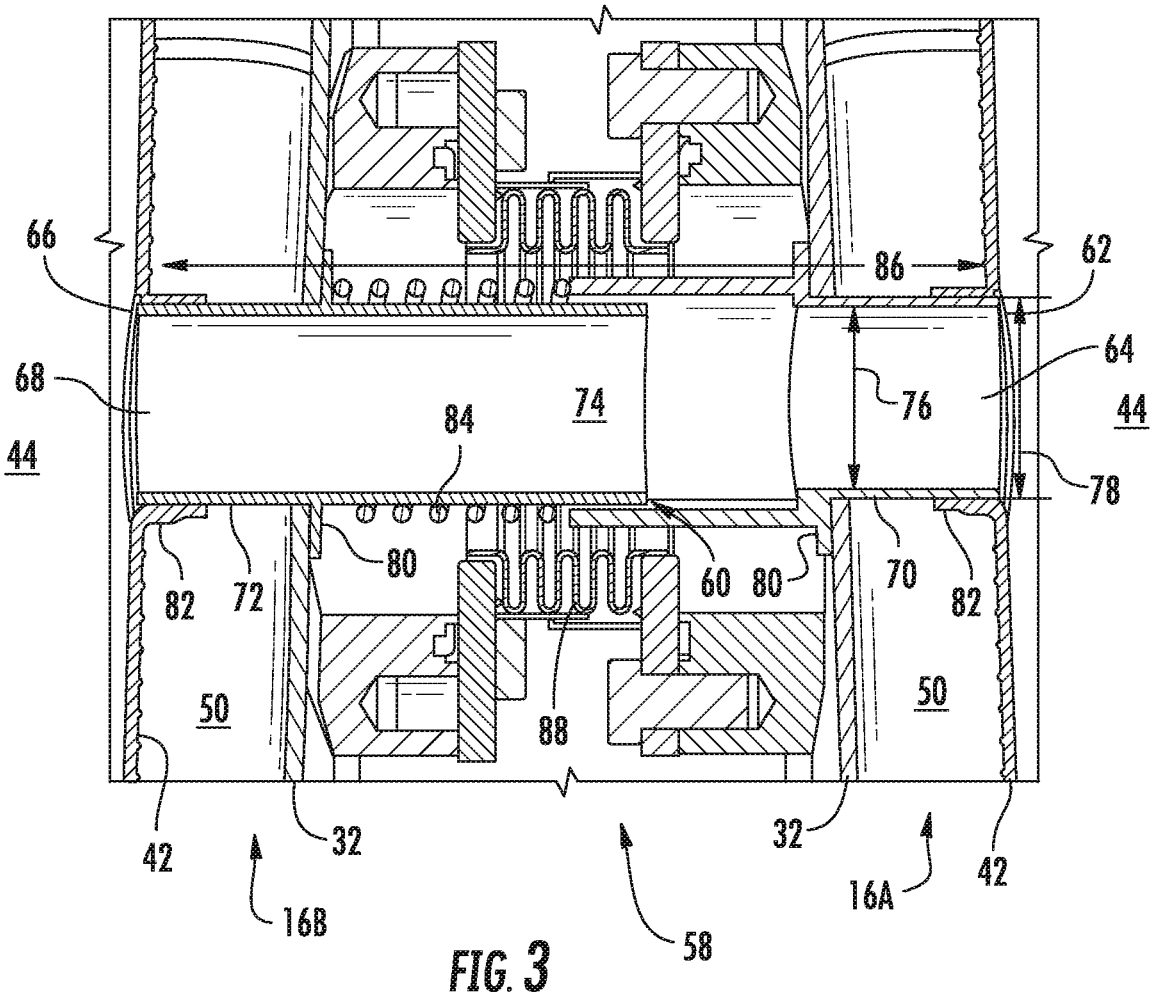
FIG. 3 is a cross-sectional side view of an exemplary cross-fire tube assembly, illustrating a telescoping tube coupled to a liner of the combustor.

As shown in FIG. 3, the crossfire tube assembly 58 generally includes an extendable or telescoping tube 60. More specifically, the telescoping tube 60 includes a first side surface 62 positioned at a first end 64 thereof and a second side surface 66 positioned at second end 68 thereof. As shown, the telescoping tube 60 includes a first tube segment 70 and a second tube segment 72 in sliding engagement with the first tube segment 70. The first tube segment 70 couples to the liner 42 of the first combustor 16A, and the second tube segment 72 couples to the liner 42 of the second combustor 16B. The telescoping tube 60 may have more than two tube segments in other embodiments. Although generally illustrated as a cylindrical tube, the telescoping tube 60 may have any suitable geometric cross-section.

In order to propagate combustion between the first and the second combustors 16A, 16B, the telescoping tube 60 defines a telescoping tube passage 74. In particular, the telescoping tube passage 74 is in fluid communication with the combustion chamber 44 of the first combustor 16A and the combustion chamber 44 of the second combustor 16B. As such, the first tube segment 70 extends through the combustor casing 32 and the liner 42 of the first combustor 16A. Similarly, the second tube segment 72 extends through the combustor casing 32 and the liner 42 of the second combustor 16B. The telescoping tube 60 has a narrowest inner diameter 76 and an outer diameter 78. As shown in FIG. 3, the outer diameter 78 is measured at the first end 64 and/or the second end 68 of the telescoping tube 60.

Various flanges, bosses, or other detents that locate the telescoping tube 60 relative to the first and second combustors 16A, 16B. In the embodiment shown in FIG. 3, for example, the telescoping tube 60 includes one or more flanges 80. Specifically, the one or more flanges 80 locate the first and/or second tubes segments 70, 72 against the combustor casings 32 of the first and/or the second combustors 16A, 16B. In some embodiments, the liners 42 of the first and/or the second combustors 16A, 16B may include a boss 82. The first end 64 and/or the second end 68 of the telescoping tube 60 may slide inside or outside of the bosses 82 to provide the aforementioned fluid communication between the telescoping tube 60 and the combustion chambers 44. Furthermore, the bosses 82 reduce or prevent the compressed air 26 from leaking into the telescoping tube 60 and/or the combustion gases 30 from leaking out of the telescoping tube 60.

In the embodiment shown in FIG. 3, the cross-fire tube assembly 58 includes a bias 84 that biases the first and the second tube segments 70, 72 apart. In this respect, the bias 84 may positively seat the one or more flanges 80 against the combustor casings 32 of the first and the second combustors 16A, 16B. Furthermore, the bias 84 couples the telescoping tube 60 to the liners 42 of the first and the second combustors 16A, 16B. In this respect, the bias 84 adjusts a length 86 of the telescoping tube 60 to accommodate varying distances and/or vibrations between the first and the second combustors 16A, 16B. In the embodiment shown in FIG. 3, the bias 84 is a compression spring that circumferentially surrounds at least a portion of the second tube segment 72. Nevertheless, the bias 84 may circumferentially surround at least a portion of the first tube segment 70 in other embodiments. Moreover, the bias 84 may be a tension spring, torsion spring, clutch, or other suitable biasing device in alternate embodiments.

In the embodiment shown in FIG. 3, the cross-fire tube assembly 58 may include a bellows 88 that circumferentially surrounds at least a portion of the telescoping tube 60. The bellows 88 may welded or otherwise connected to the combustor casings 32 of the first and second combustor 16A, 16B to provide an expandable barrier therebetween. Some embodiments of the cross-fire tube assembly 58 may not include the bellows 88.

FIGS. 4-10 illustrate various components of a tool kit 100 for decoupling the telescoping tube 60 of the cross-fire tube assembly 58 from the liner 42, the first combustor 16A, the second combustor 16B, and/or any other combustor 16 in the gas turbine engine 10. In general, the tool kit 100 includes a plunger assembly 102, one or more retaining clips 104, and a plurality of connectors 106.

FIGS. 4-7 illustrate the plunger assembly 102 in greater detail. More specifically, the plunger assembly 102 includes a base plate 108 having a first end 110 spaced apart from a second end 112. Furthermore, the base plate 108 includes a top surface 114, a bottom surface 116 spaced apart from the top surface 114, a front surface 118, and a rear surface 120 spaced apart from the front surface 118. The base plate 108 defines a notch 122 positioned between the first and second ends 110, 112 thereof. In particular, the notch 122 extends inwardly from the rear surface 120 of the base plate 108 toward the front surface 118 of the base plate 108. The notch 122 also extends through the entire thickness of the base plate 108. That is, the notch 122 extends through the top and bottom surfaces 114, 116 of the base plate 108. In the embodiment shown in FIGS. 4-6, the base plate 108 is arcuate. Nevertheless, the base plate 108 may have any suitable shape.

Figure 4:
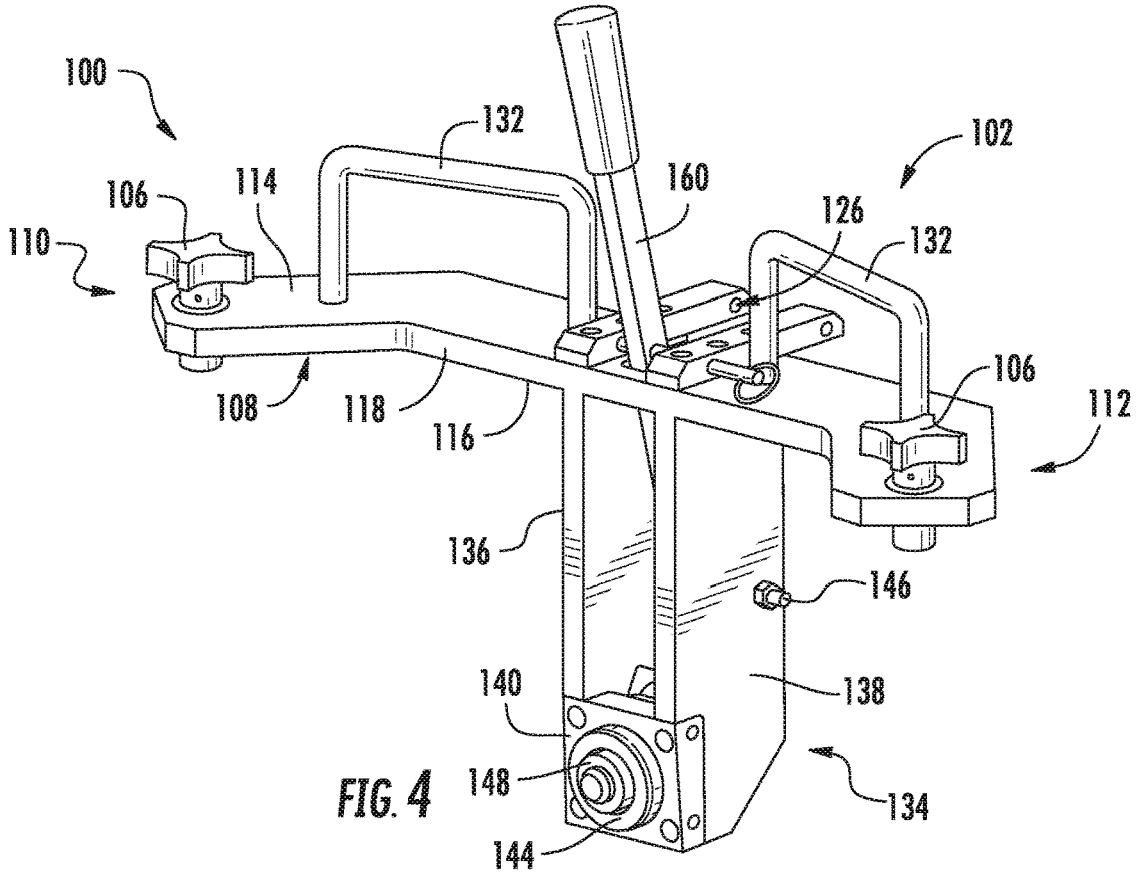
FIG. 4 is a front perspective view of a plunger assembly, which may be part of a tool kit for decoupling the telescoping tube in accordance with the embodiments disclosed herein.
Figure 5:
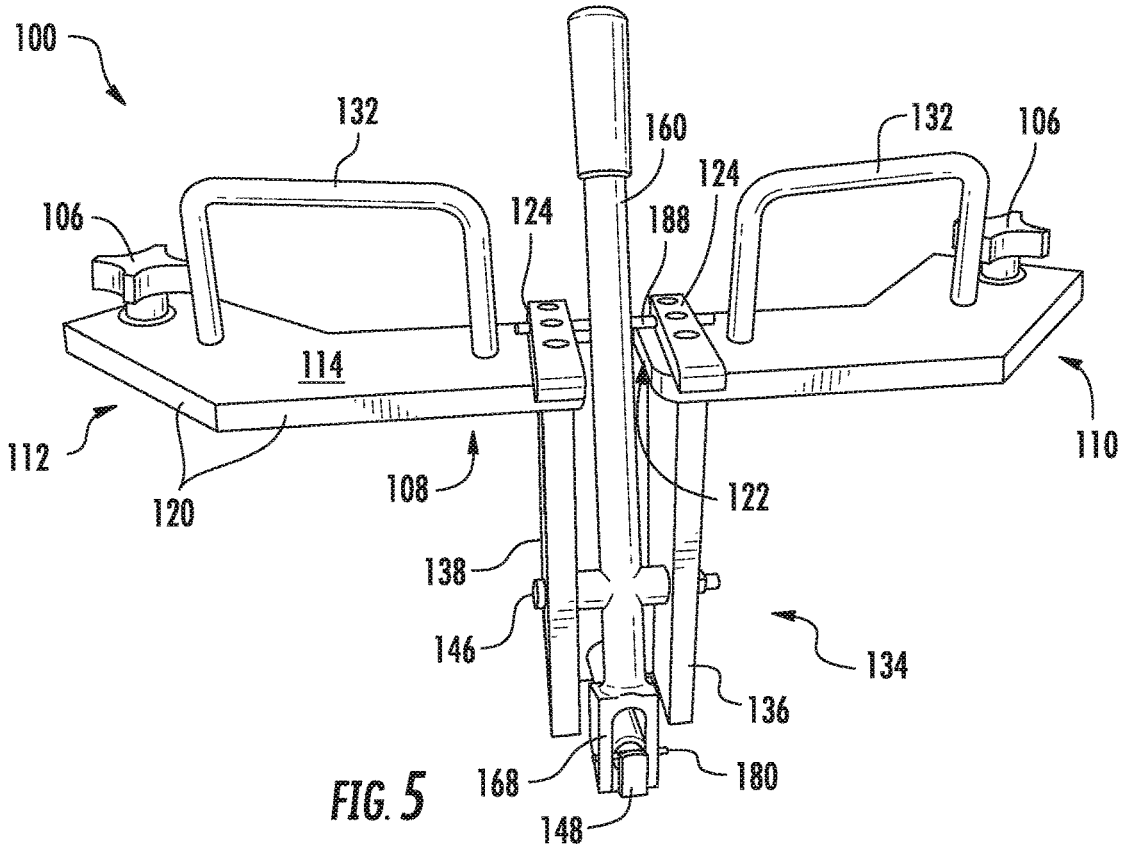
FIG. 5 is a rear perspective view of the plunger assembly, further illustrating various features thereof.

The plunger assembly 102 includes at least one pin block 124 coupled to the top surface 114 of the base plate 108. In the embodiment shown in FIGS. 4-6, one pin block 124 is positioned on each side of and adjacent to the notch 122. Furthermore, the pin blocks 124 may extend past the rear surface 120 of the base plate 108 such that portions of the pin blocks 124 are not supported by the base plate 108 in some embodiments. In other embodiments, however, only one pin block 124 may couple to the top surface 114 of the base plate 108 and/or the pin blocks 124 may be entirely supported by the base plate 108. Each of the pin blocks 124 defines a first pin block aperture 126 and a second pin block aperture 128 spaced apart from the first pin block aperture 126. As best shown in FIG. 6, the portion of each pin block 124 unsupported by the base plate 108, if present, may define the first pin block aperture 126 in certain embodiments. If the plunger assembly 102 includes two pin blocks 124 (i.e., one pin block 124 on each side of the notch 122 as shown in FIGS. 4-6), the first pin block apertures 126 of each of the pin blocks 124 are coaxial. Similarly, the second pin block apertures 128 of each of the pin blocks 124 are also coaxial. The pin blocks 124 may also define additional pin block apertures (not shown) located between the first and the second pin block apertures 126, 128 in some embodiments.

One or more connectors 106 couple to each of the first and second ends 110, 112 of the base plate 108. In the embodiment shown in FIGS. 4-6, one connector 106 is positioned at each of the first and second ends 110, 112. Although, two or more connectors 106 may be positioned at each of the first and second ends 110, 112 in other embodiments. The connectors 106 will be discussed in greater detail below.

In the embodiment shown in FIGS. 4-6, a pair of handles 132 extends outwardly from the top surface 114 of the base plate 108. In particular, each handle 132 is positioned between the notch 122 and one of the connectors 106. In other embodiments, zero, one, three, or more handles 132 may extend outwardly from the top surface 114 of the base plate 108. The handles 132 may have any suitable size, shape, and/or configuration.

The plunger assembly 102 also includes a post 134 that extends outward from the bottom surface 116 of the base plate 108. As shown in FIGS. 4-7, the post 134 includes a first side plate 136 and a second side plate 138 spaced apart from the first side plate 136. The first and second side plates 136, 138 extend outwardly from the bottom surface 116 of the base plate 108 and are positioned adjacent to the notch 122. As shown in FIGS. 4 and 6, the first side plate 136 is positioned between the notch 122 and the first end 110 of the base plate 108. Conversely, the second side plate 138 is positioned between the notch 122 and the second end 112 of the base plate 108. A bushing plate 140 extends between and couples to the first and the second side plates 136, 138. The bushing plate 140 is spaced apart from the base plate 108. As shown in FIG. 7, the bushing plate 140 defines a bushing plate aperture 142 extending therethrough. In certain embodiments, a bushing 144 may be positioned into the bushing plate aperture 142. A pivot shaft 146 extends between and couples the first and the second side plates 136, 138. As best shown in FIG. 4, the pivot shaft 146 may be positioned between the bushing plate 140 and the base plate 108. Furthermore, the pivot shaft 146 may be positioned between the first and second pin block apertures 126, 128. The post 134 may have other suitable configurations as well.

The plunger assembly 102 further includes a plunger 148 having an outer surface 150, a side surface 152, and a plunger diameter 154. The plunger diameter 154 is greater than the narrowest inner diameter 76 of the telescoping tube 60 and less than the outer diameter 78 of the telescoping tube 60. A boss 156 having a boss diameter 158 extends outwardly from the outer surface 150 of the plunger 148. The boss diameter 158 is less than the plunger diameter 154 and the narrowest inner diameter 76 of the telescoping tube 60. As shown in FIGS. 4-6, the plunger 148 is slidably received in the bushing plate aperture 142. In this respect, the plunger 148 is slidable between a retracted position shown in FIG. 4 and an extended position shown in FIG. 6. The plunger 148 is in the retracted position when it extends outwardly (i.e., in the direction extending from the rear surface 120 of the base plate 108 to the front surface 118 of the base plate 108) from the bushing plate 140 a minimum distance. Conversely, the plunger 148 is in the extended position when it extends outwardly from the bushing plate 140 a maximum distance. Although generally illustrated having a circular cross-section, the plunger 148 and the boss 156 may have any suitable geometric cross-sections.

The plunger assembly 102 includes a lever arm 160 pivotably coupled to the post 134 and the plunger 148 for actuating the plunger 148. More specifically, the lever arm 160 includes a first end 162 and a second end 164 spaced apart from the first end 162. As shown in FIGS. 4-6, the first end 162 of the lever arm 160 is generally positioned above the top surface 114 of the base plate 108. Conversely, the second end 164 of the lever arm 160 is positioned below the bottom surface 116 of the base plate 108 and generally aligned with the plunger 148 as will be discussed in greater detail below. The first end 162 of the lever arm 160 may optionally include a handle or grip 166 to facilitate user manipulation thereof.

The lever arm 160 may include a fork 168 positioned at the second end 164 thereof that pivotably couples to the plunger 148. More specifically, the fork 168 includes a first fork arm 170 spaced apart from a second fork arm 172. In this respect, the first and the second fork arms 170, 172 define a slot 174 therebetween that receives a portion of the plunger 148. The first and the second fork arms 170, 172 respectively define a first fork arm aperture 176 and a second fork arm aperture 178 that is coaxial with the first fork arm aperture 176. A pivot pin 180 may extend through the first and second arm apertures 174, 176 to pivotably couple the lever arm 160 and the plunger 148. Some embodiments may not include the fork 168.

The lever arm 160 defines a pivot aperture 182 extending therethrough. As best shown in FIGS. 5 and 8, the pivot aperture 182 is located between the first and the second ends 162, 164 of the lever arm 160 and generally aligned with the pivot shaft 146 extending between the first and second side plates 136, 138. As such, the pivot shaft 146 is positioned in the pivot aperture 182 to pivotably couple the lever arm 160 and the post 134. In the embodiment shown in FIGS. 5 and 8, a sleeve 184 extends outwardly from opposing sides of the lever arm 160 and further defines the pivot aperture 182. Although, some embodiments may not include the sleeves 184.

Furthermore, the lever arm 160 defines a locking aperture 186 extending therethrough and positioned between the first end 162 and the pivot aperture 182. A locking pin 188 may be positioned in the locking aperture 186 and either the first pin block apertures 126 or the second pin block apertures 128 to prevent movement of the lever arm 160. In this respect, the locking aperture 186 is coaxial with the first pin block aperture 126 when the lever arm 160 is aligned with the first pin block aperture 126. Similarly, the locking aperture 186 is coaxial with the second pin block aperture 128 when the lever arm 160 is aligned with the second pin block aperture 128.

As mentioned above, the tool kit 100 also includes the one or more retaining clips 104. In particular, the tool kit 100 includes at least as many retaining clips 104 as there are cross-fire tube assemblies 58 that couple to the combustor 16. For example, if two cross-fire tube assemblies 58 couple to the combustor 16, the tool kit 100 will include at least two retaining clips 104. As will be discussed in greater detail below, each retaining clip 104 holds the telescoping tube 60 of one of the cross-fire tube assemblies 58 in a decoupled position. The decoupled position is where the telescoping tube 60 is not in contact with or connected to the liner 42. In some embodiments, the tool kit 100 may include more retaining clips 104 than there are cross-fire tube assemblies 58 that couple to the combustor 16 to provide, e.g., spare retaining clips 104.

Now referring to FIG. 9, each retaining clip 104 includes a base plate 190 having a first end 192 spaced apart from a second end 194. The base plate 190 also includes a top surface 196, a bottom surface 198 spaced apart from the top surface 196, a front surface 200, and a rear surface 202 spaced apart from the front surface 200. A clip arm 204 extends outwardly from the bottom surface 198 of the base plate 190. The clip arm 204 includes a front surface 206, a rear surface 208 spaced apart from the front surface 206, and a bottom surface 210 spaced apart from the bottom surface 198 of the base plate 190. As shown in FIG. 9, the front and rear surfaces 206, 208 of the clip arm 204 are generally parallel to and spaced apart from the front surface 200 of the base plate 190. The clip arm 204 defines a notch 212 having a notch width 214 greater than the plunger diameter 154. In particular, the notch 212 extends inwardly from the bottom surface 210 of the clip arm 204 and through the entire thickness of the clip arm 204. That is, the notch 212 extends through the front and rear surfaces 206, 208 of the clip arm 204.

One or more connectors 106 couple to each of the first and second ends 192, 194 of the base plate 190. In the embodiment shown in FIG. 9, one connector 106 is positioned at each of the first and second ends 192, 194. Although, two or more connectors 106 may be positioned at each of the first and second ends 192, 194 in other embodiments.

Figure 11:
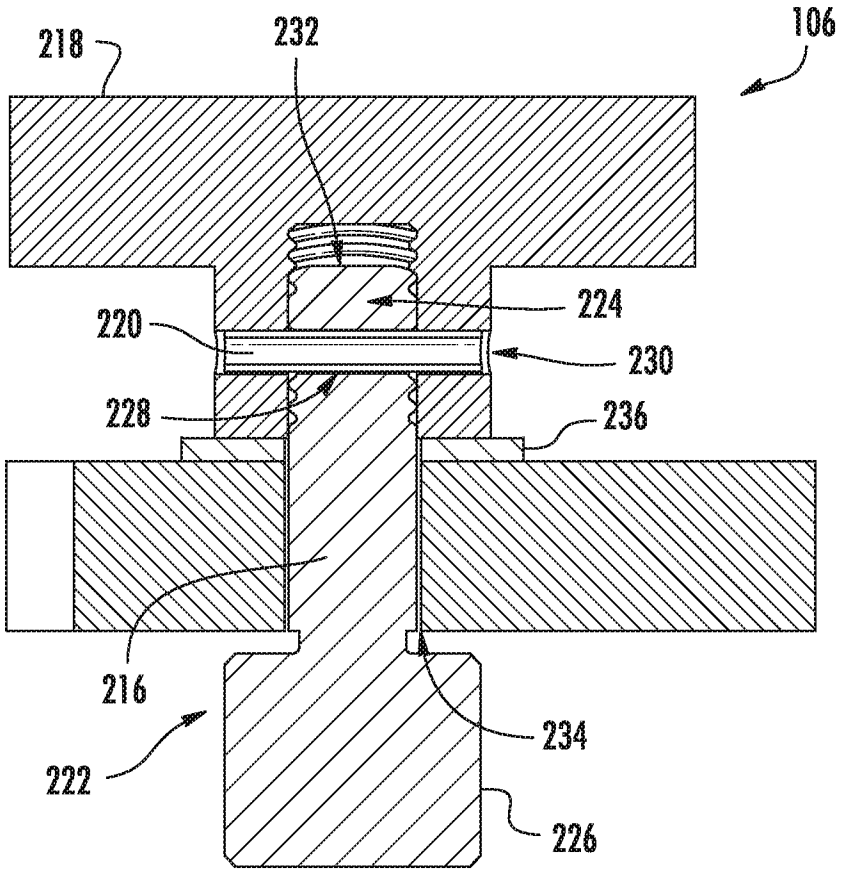
FIG. 11 is a cross-sectional view of the connector taken generally about line 11-11 in FIG. 10, further illustrating the features thereof.
Figure 10:
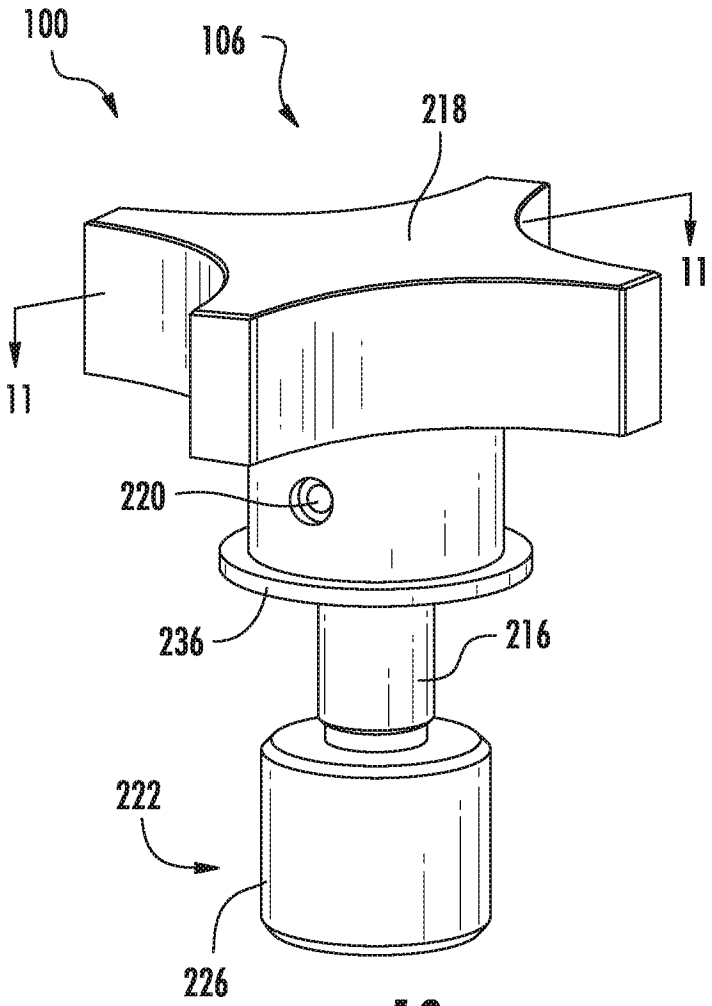
FIG. 10 is a perspective view of a connector, which may be part of the tool kit for decoupling the telescoping tube in accordance with the embodiments disclosed herein.

FIGS. 10 and 11 illustrate one embodiment of the connectors 106, which may couple to the base plate 108 of the plunger assembly 102 and/or the base plate 190 of the retaining clips 104. As shown, each connector 106 includes a stud 216, a knob 218, and a pin 220. The stud 216 includes a first end 222 spaced apart from a threaded second end 224. The first end 222 includes a circumferential boss 226 extending outwardly therefrom. The threaded second end 224 defines an aperture 228 extending therethrough. The knob 218 defines an aperture 230 extending therethrough and a threaded cavity 232 oriented generally perpendicularly to the aperture 230. As shown in FIG. 11, the aperture 230 extends through the threaded cavity 232. The pin 220 may be a spring pin or any other suitable pin. In other embodiments, the connector 106 may include other components or have other configurations.

FIG. 11 illustrates the connector 106 assembled and coupled to the base plate 108 of the plunger assembly 102. In particular, the stud 216 extends through an aperture 234 defined by the base plate 108 such that the circumferential boss 226 is positioned below the bottom surface 116 of the base plate 108 and the threaded second end 224 is positioned above the top surface 114 of the base plate 108. As shown, the circumferential boss 226 is wider than the aperture 234 in the base plate 108. The knob 218 threadingly couples to the threaded second end 224 of the stud 216. That is, the threaded second end 224 of the stud 216 is threadingly received in the threaded cavity 232 of the knob 218 such that the aperture 228 in the stud 216 is coaxial with the aperture 230 in the knob 218. The pin 220 is positioned in the apertures 228, 230, thereby coupling the knob 218 and the stud 216. A washer 236 may be positioned between the knob 218 and the top surface 114 of the base plate 108. The connector 106 may couple to the base plate 190 of the retaining clips 104 in same manner.

Figure 12:
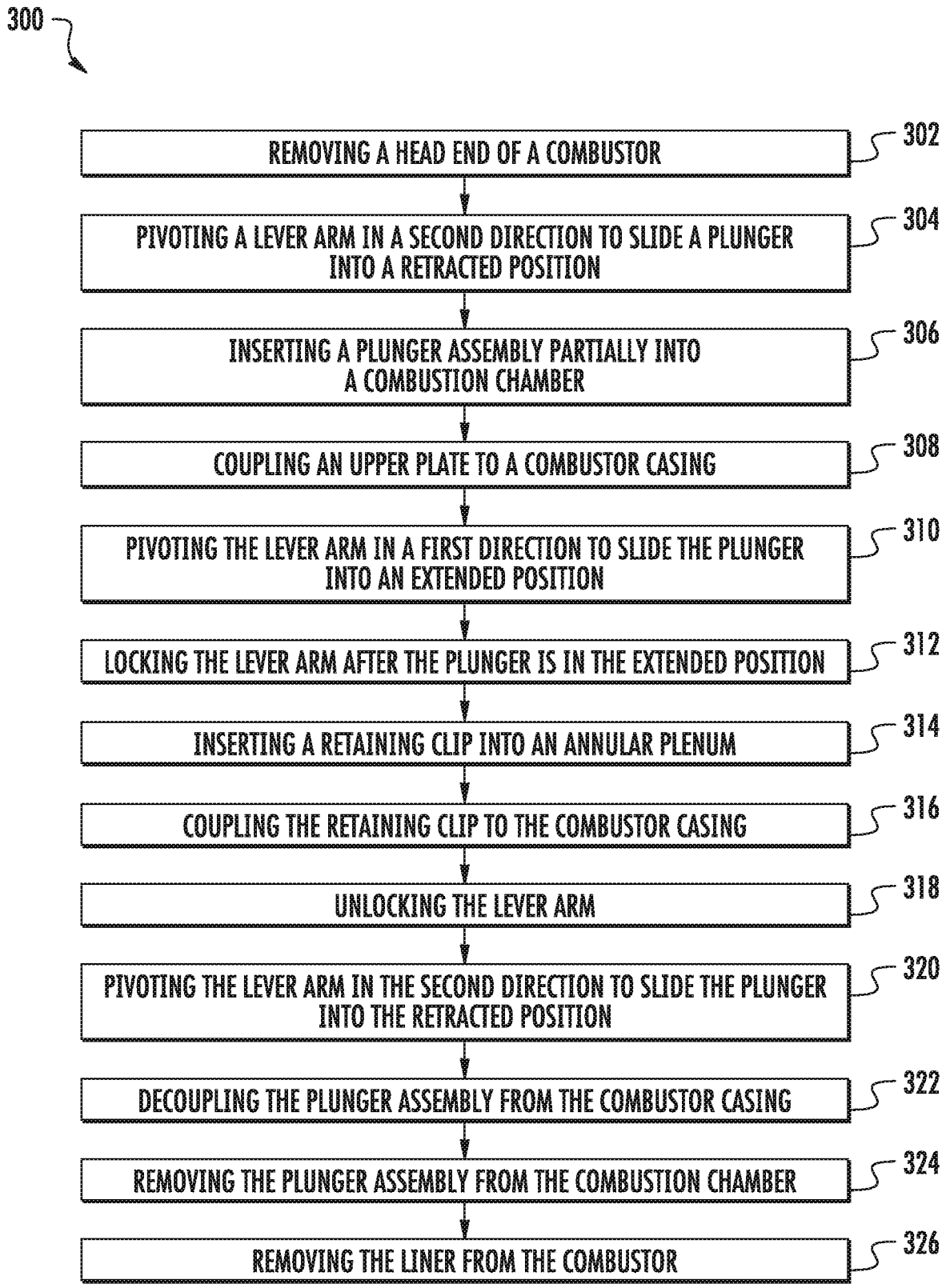
FIG. 12 is a flow chart illustrating a method for using the tool kit to decouple the telescoping tube in accordance with the embodiments disclosed herein.

FIG. 12 is a flowchart illustrating an exemplary method 300 for using the tool kit 100 to decouple the telescoping tube 60 from the liner 42 in accordance with the embodiments disclosed herein. FIGS. 13-19 illustrate various steps of the method 300. In step 302, the head end 38 of the combustor 16 or a portion thereof is removed to provide access to the combustion chamber 44 and a flange 90 of the combustor casing 32.

In step 304, the lever arm 160 of the plunger assembly 102 is pivoted in a second direction to slide the plunger 148 into the retracted position (FIG. 4). In the embodiments shown in FIGS. 4-6 and 13-19, for example, pivoting the first end 162 of the lever arm 160 toward the front surface 118 of the base plate 108 slides the plunger 148 into the retracted position. Nevertheless, the lever arm 160 may be manipulated differently to place the plunger 148 in the retracted position in other embodiments of the plunger assembly 102. The locking pin 188 may be inserted into the second pin block apertures 128 and the locking aperture 186 of the lever arm 160 to lock the plunger 148 in the retracted position. The plunger 148 should be in the retracted position before installation of the plunger assembly 102 in the combustion chamber 44.

Figure 13:
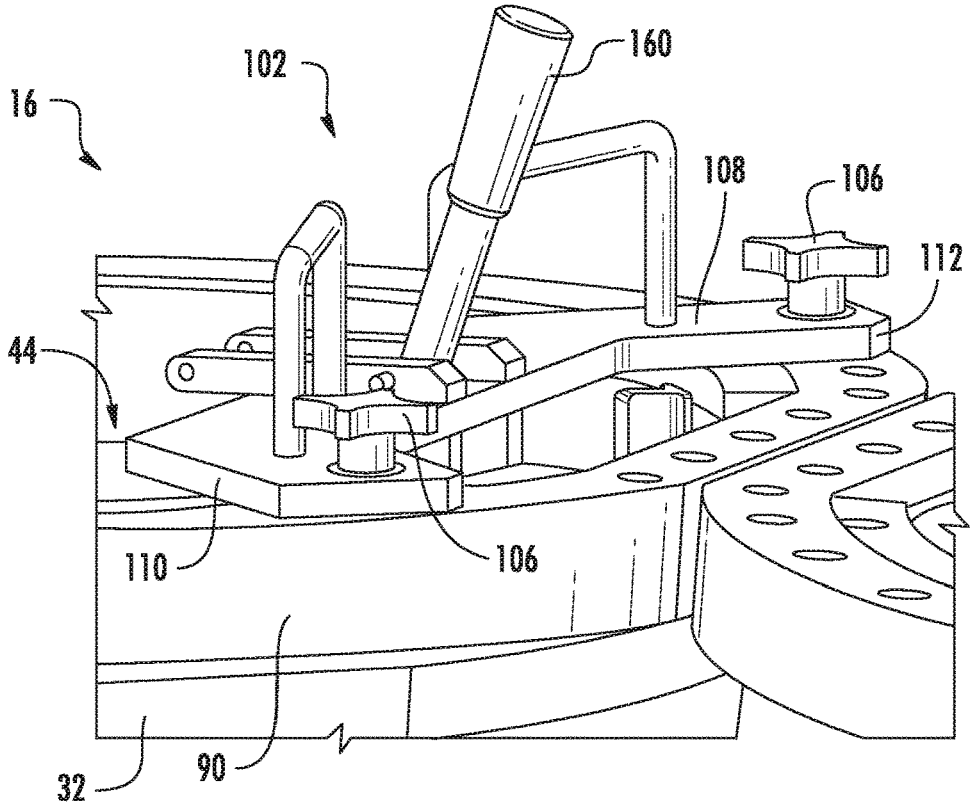
FIG. 13 is a perspective view of a portion of the combustor, illustrating the plunger assembly coupled to a combustor casing.
Figure 14:
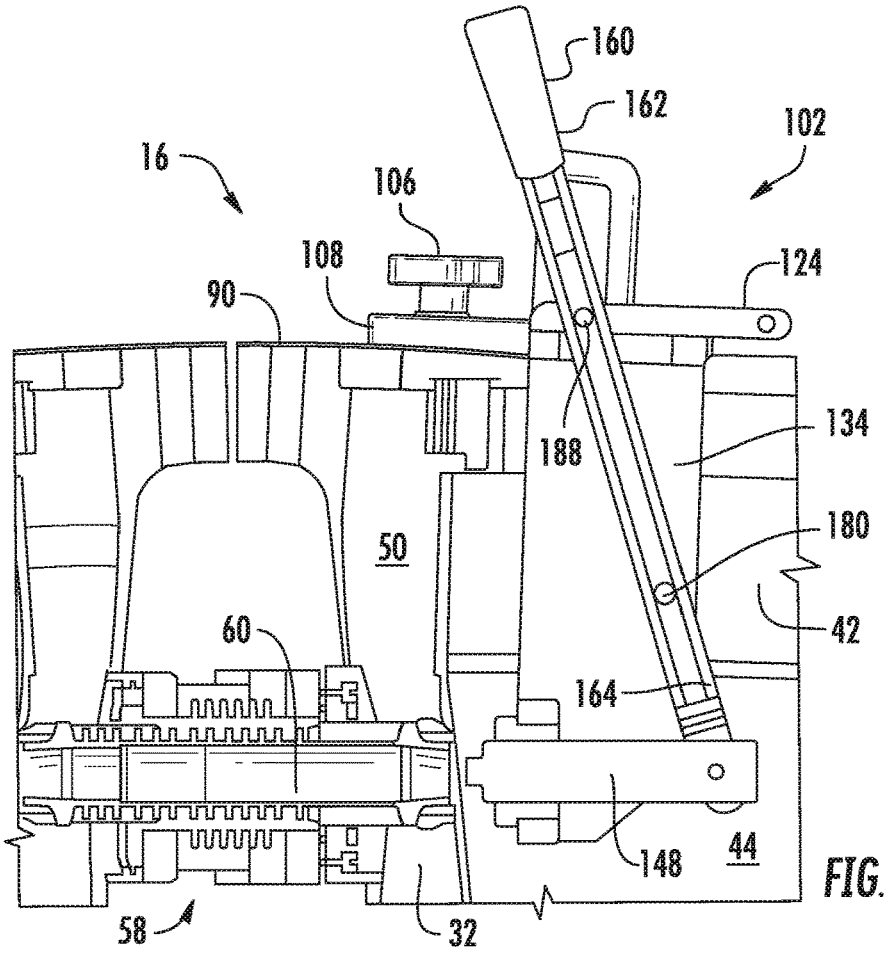
FIG. 14 is a cross-sectional view of the combustor, illustrating the positioning of the plunger assembly in a combustion chamber.
Figure 15:
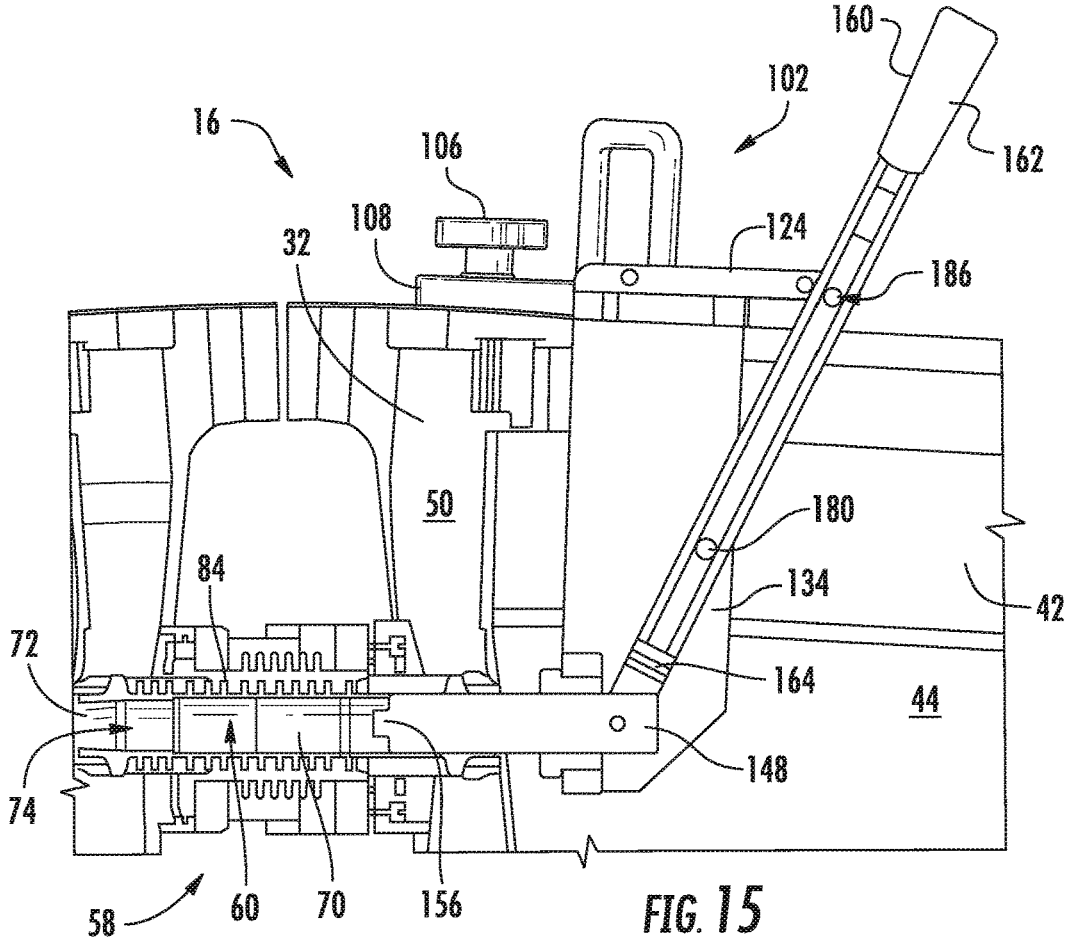
FIG. 15 is a cross-sectional view of the combustor, illustrating the telescoping tube decoupled from the liner.
Figure 16:
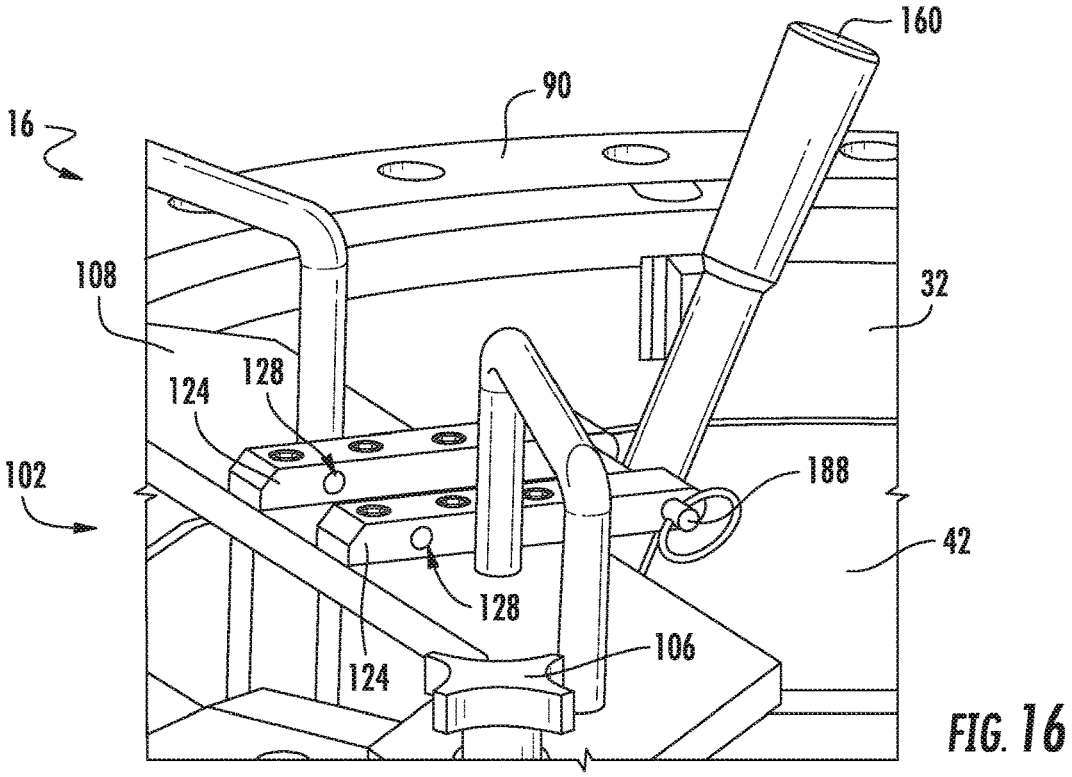
FIG. 16 is a perspective view of a portion of the combustor, illustrating a locking pin locking the position of the lever arm.

The plunger assembly 102 is partially inserted into the combustion chamber 44 in step 306 and coupled to the combustor casing 32 in step 308. FIGS. 13 and 14 illustrate the positioning of the plunger assembly 102 upon completion of step 308. Referring particularly to FIG. 13, a pair of the connectors 106 couples the first and second ends 110, 112 of the base plate 108 to the flange 90 of the combustor casing 32. The arcuate shape of the base plate 108 permits the base plate 108 to extend inwardly from the combustor casing 32. As such, a portion of the base plate 108 is positioned over the combustion chamber 44 when the plunger assembly 102 is coupled to the combustor casing 32. Referring now to FIG. 14, the post 134 extends down into the combustion chamber 44 such that the plunger 148 is aligned (i.e., coaxial) with the telescoping tube 60.

In step 310, the lever arm 160 of the plunger assembly 102 is pivoted in the first direction to slide the plunger 148 into the extended position (FIG. 6). The locking pin 188 may need to be removed from the second pin block apertures 128 and the locking aperture 186 of the lever arm 160 to permit movement of the lever arm 160 from the retracted position to the extended position. In the embodiments shown in FIGS. 4-6 and 13-19, for example, pivoting the first end 162 of the lever arm 160 toward the rear surface 120 of the base plate 108 pushes the plunger 148 into the extended position. Nevertheless, the lever arm 160 may be manipulated differently to place the plunger 148 in the extended position in other embodiments of the plunger assembly 102. The locking pin 188 may be inserted into the first pin block apertures 126 and the locking aperture 186 of the lever arm 160 to lock the plunger 148 in the extended position.

Moving the plunger 148 into the extended position in accordance with step 310 decouples the telescoping tube 60 from the liner 42 of the combustor 16. As the plunger 148 moves from the retracted position to the extended position, the outer surface 150 (FIG. 6) of the plunger 148 contacts the first side surface 62 (FIG. 3) of the telescoping tube 60. Once this contact occurs, the boss 156 extending outward from the plunger 148 is positioned in the telescoping tube passage 74 to prevent the plunger 148 from sliding off of the telescoping tube 60. As the plunger 148 continues to move toward the extended positioned, the plunger 148 compresses the bias 84 and slides the first tube segment 70 relative to the second tube segment 72. Once the plunger 148 reaches the extended position, the first tube segment 70 has moved out of contact with the liner 42, thereby decoupling the telescoping tube 60 from the liner 42.

In step 312, the position of the lever arm 160 is locked after the plunger 148 is moved to the extended position. As mentioned above, the locking aperture 186 of the lever arm 160 is aligned (i.e., coaxial) with the first pin block apertures 126 once the plunger 148 is in the extended position. In this respect, the locking pin 188 is positioned in the locking aperture 186 and the first pin block apertures 126 to prevent movement of the lever arm 160 relative to the base plate 108.

Figure 17:
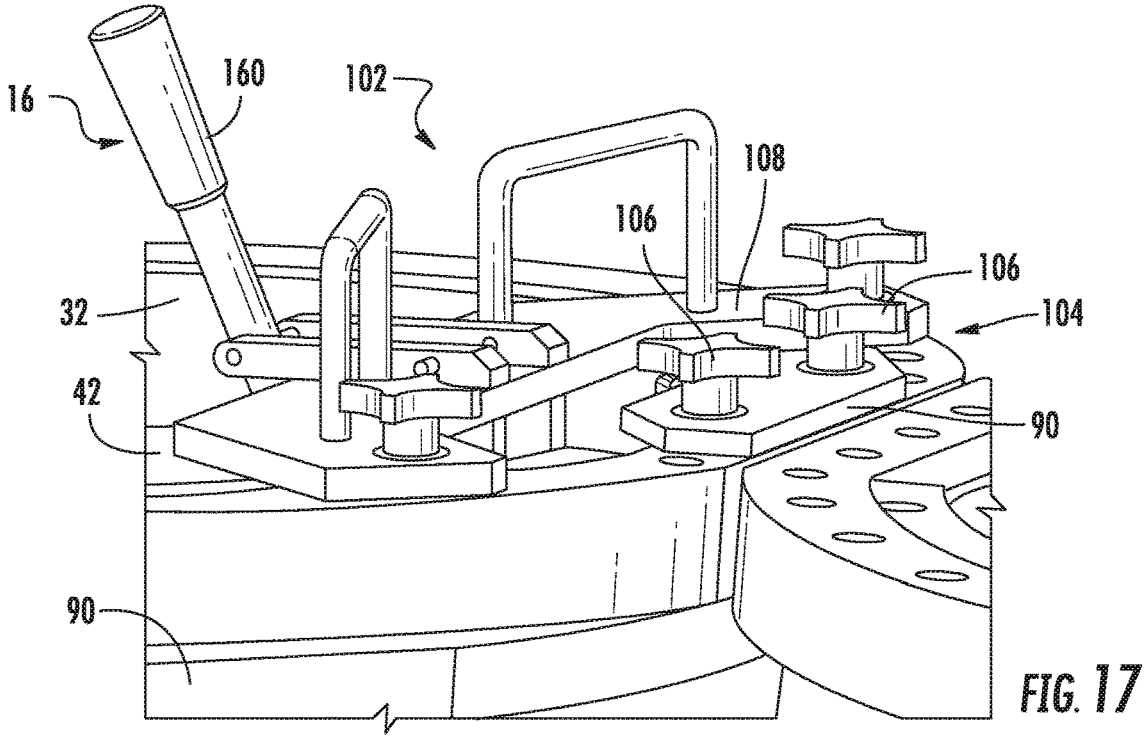
FIG. 17 is a perspective view of a portion of the combustor, illustrating the retaining clip coupled to the combustor casing.
Figure 18:
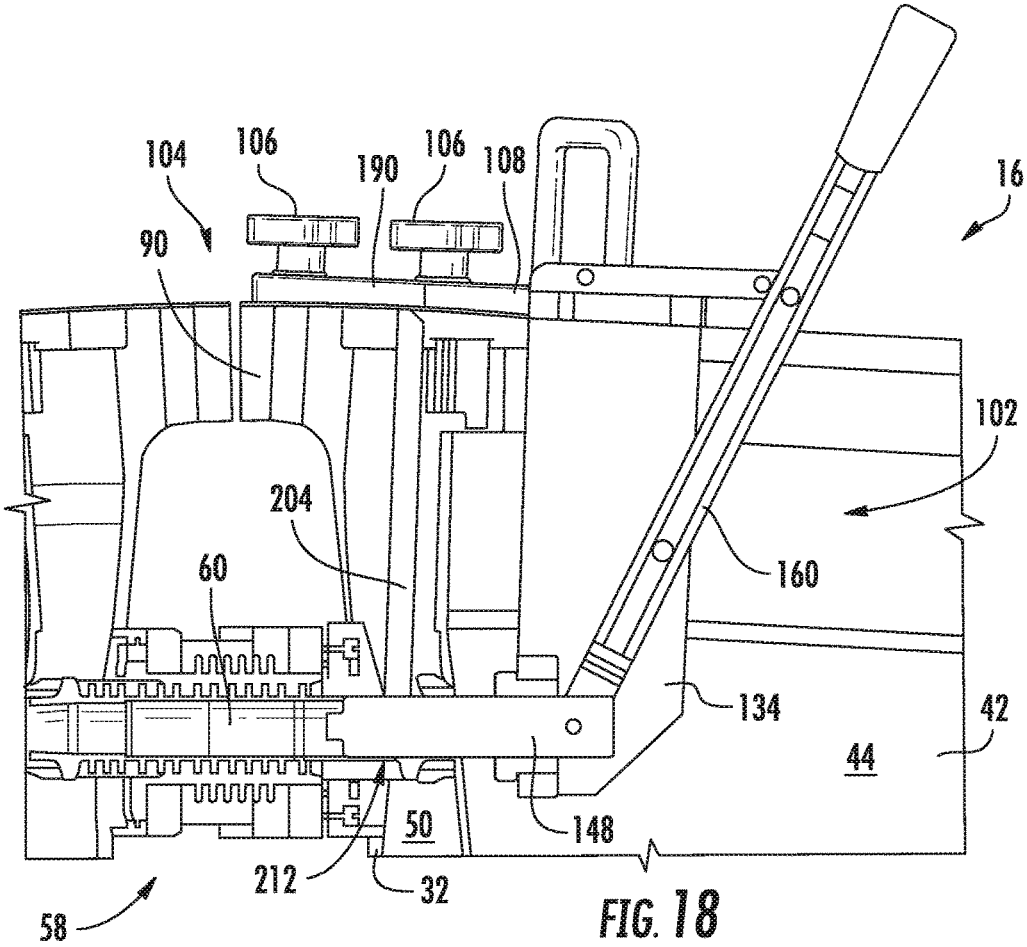
FIG. 18 is a cross-sectional view of a portion of the combustor, illustrating the positioning of the retaining clip in an annular plenum between the combustor casing and the liner.

The retaining clip 104 is partially inserted into the annular plenum 50 in step 314 and coupled to the combustor casing 32 in step 316. FIGS. 17 and 18 illustrate the positioning of the retaining clip 104 upon completion of step 316. Referring particularly to FIG. 17, a pair of the connectors 106 couples the first and second ends 192, 194 of the base plate 190 to the flange 90 of the combustor casing 32. A portion of the base plate 108 is positioned over the annular plenum 50 when the retaining clip 104 is coupled to the combustor casing 32. Referring now to FIG. 14, the clip arm 204 extends down into the annular plenum 50 such that a portion of the plunger 148 is positioned in the notch 212.

The lever arm 160 is unlocked in step 318 and pivoted in the second direction to slide the plunger into the retracted position in step 320. In particular, the locking pin 188 is removed from the locking aperture 186 of the lever arm 160 and the first pin block apertures 126 to unlock the lever arm 160. After pivoting the lever arm 160 to move the plunger 148 into the retracted position, the locking pin 188 is inserted into the second pin block apertures 128 and the locking aperture 186 of the lever arm 160 to lock the plunger 148 in the retracted position.

Figure 19:
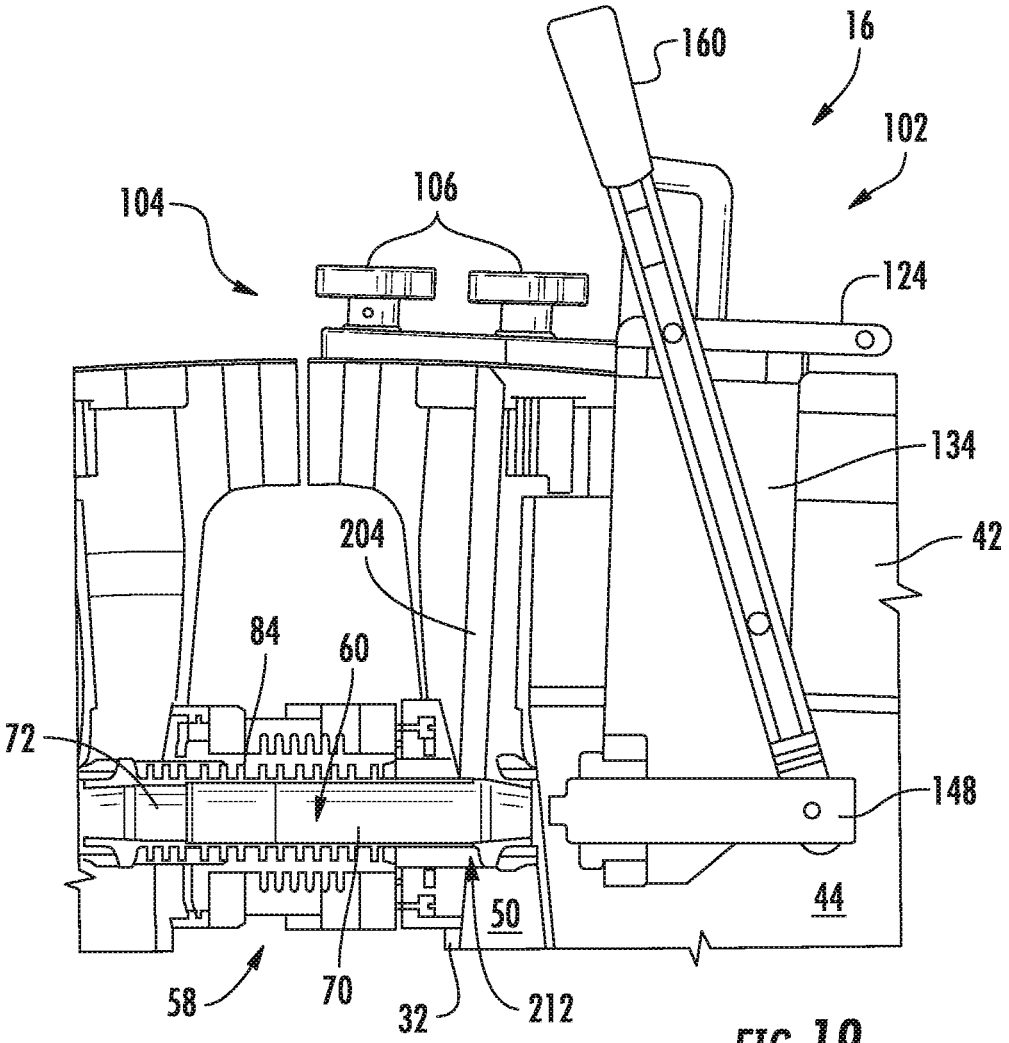
FIG. 19 is a cross-sectional view of a portion of the combustor, illustrating the retaining clip holding the telescoping tube in a decoupled position.

Upon completion of step 318, the retaining clip 104 holds the telescoping tube 60 in the decoupled position. That is, the retaining clip 104 prevents the bias 84 from pushing the first tube segment 70 back into contact with the liner 42. More specifically, the bias 84 pushes the first tube segment 70 toward the liner 42 once the plunger 148 moves to the retracted position in accordance with step 320. In this respect, the retaining clip 104 catches the first tube segment 70 of the telescoping tube 60, thereby preventing further movement toward the liner 42. As shown in FIG. 19, a portion of the first tube segment 70 is positioned in the notch 212 upon completion of step 320.

Once the plunger 148 is moved to the retracted position in accordance with step 320, the plunger assembly 102 is decoupled from the flange 90 of the combustor casing 32. In the embodiments of the plunger assembly 102 shown in FIGS. 4-6 and 13-19, the plunger assembly 102 is decoupled from the flange 90 by removing the connectors 106. In step 324, the plunger assembly 102 is removed from the combustion chamber 44 of the combustor 106.

Steps 308-322 may be repeated for any additional cross-fire tube assemblies 58 coupled to the combustor 16. As such, additional retaining clips 104 may be necessary to hold additional telescoping tubes 60 in the decoupled position. Nevertheless, the same plunger assembly 102 may be used to decouple each cross-fire tube assembly 58. Once all of the cross-fire tube assemblies 58 are decoupled from the liner 42, various maintenance operations may performed on the combustor 16. For example, the liner 42 may optionally be removed from the combustor 16 in step 326.

The tool kit 100 and the method 300 disclosed herein decouple the telescoping tube 60 of the cross-fire tube assembly 58 from the liner 42 of the combustor 16. In particular, the tool kit 100 and the method 300 only require the removal of the head end 38 or a portion the head end 38 of the combustor 16 containing the liner 42 from which the telescoping tube 60 is to be decoupled. In this respect, and unlike conventional tools and methods, the head ends of adjacent combustors need not be removed in order to use of the tool kit 100 or the method 300 to decouple cross-fire tube assemblies 58.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A tool kit for decoupling a telescoping tube from a liner of a component, the tool kit comprising:

a plunger assembly comprising:

a base plate that couples to a casing;

a post extending outward from the base plate into a chamber at least partially defined by the liner, wherein the post includes a bushing plate that defines a bushing plate aperture extending therethrough;

a plunger slidably received within the bushing plate aperture, the plunger slidable relative to the post between an extended position and a retracted position; and a lever arm pivotably coupled to the post and to the plunger, wherein pivoting the lever arm in a first direction slides the plunger within the bushing plate aperture relative to the post to the extended position to decouple the telescoping tube from the liner; and a retaining clip that couples to the casing and extends into an annular plenum at least partially defined between the liner and the casing, the retaining clip defining a notch that receives the telescoping tube after the plunger assembly decouples the telescoping tube from the liner.

2. The tool kit of claim 1, wherein the plunger assembly comprises a pin block coupled to the base plate, the pin block defining a pin block aperture extending therethrough, wherein the lever arm defines a lever arm aperture extending therethrough, and wherein a pin extends through the pin block aperture and the lever arm aperture to prevent the lever arm from sliding from the extended positioned to the retracted position or from the retracted position to the extended position.

3. The tool kit of claim 1, wherein one or more connectors couple at least one of the plunger assembly and the retaining clip to the casing, each connector comprising a stud, a knob, and a pin that couples the knob to the stud.

4. The tool kit of claim 1, wherein the post comprises a first side plate coupled to the base plate and a second side plate coupled to the base plate and spaced apart from the first side plate, the bushing plate coupled to the first side plate and the second side plate and spaced apart from the base plate.

5. The tool kit of claim 1, wherein the base plate is arcuate and extends over a portion of the combustion chamber.

6. The tool kit of claim 1, wherein pivoting the lever arm in a second direction slides the plunger within the bushing plate aperture relative to the post to the retracted position.

7. A system for decoupling telescoping tubes from liners of a gas turbine engine, the system comprising:

a liner that at least partially defines a combustion chamber;

a combustor casing surrounding at least a portion of the liner and spaced apart from the liner, the combustor casing and the liner at least partially defining an annular plenum therebetween;

a telescoping tube extending through the combustor casing and coupled to the liner; and a plunger assembly comprising:

a base plate coupled to the combustor casing;

a post extending outward from the base plate into the combustion chamber, wherein the post includes a bushing plate that defines a bushing plate aperture extending therethrough;

a plunger positioned in the combustion chamber and slidably received by the bushing plate aperture, the plunger aligned with the telescoping tube and slidable relative to the post between an extended position and a retracted position; and a lever arm pivotably coupled to the post and to the plunger, wherein pivoting the lever arm in a first direction slides the plunger within the brushing plate aperture relative to the post and into contact with the telescoping tube and into the extended position to decouple the telescoping tube from the liner; and a retaining clip coupled to the combustor casing and extending into the annular plenum, the retaining clip defining a notch that receives the telescoping tube after the plunger assembly decouples the telescoping tube from the liner.

8. The system of claim 7, wherein the plunger assembly comprises a pin block coupled to the base plate, the pin block defining a pin block aperture extending therethrough, wherein the lever arm defines a lever arm aperture extending therethrough, and wherein a pin extends through the pin block aperture and the lever arm aperture to prevent the lever arm from sliding from the extended positioned to the retracted position or from the retracted position to the extended position.

9. The system of claim 7, wherein one or more connectors couple at least one of the plunger assembly and the retaining clip to the combustor casing, each connector comprising a stud, a knob, and a pin that couples the knob to the stud.

10. The system of claim 7, wherein the post comprises a first side plate coupled to the base plate and a second side plate coupled to the base plate and spaced apart from the first side plate, wherein the bushing plate is coupled to the first side plate and the second side plate and spaced apart from the base plate.

11. The system of claim 7, wherein the base plate is arcuate and extends over a portion of the combustion chamber.

12. The system of claim 7, wherein pivoting the lever arm in a second direction slides the plunger to the retracted position.

13. A method for decoupling a telescoping tube from a liner of a combustor of a gas turbine engine, the method comprising:

inserting a plunger assembly partially into a combustion chamber defined by the liner, the plunger assembly comprising a base plate, a post extending outward from the base plate into the combustion chamber, the post including a bushing plate that defines a bushing plate aperture extending therethrough, a plunger positioned in the combustion chamber and slidably received by the bushing plate aperture, the plunger aligned with the telescoping tube and slidable relative to the post between an extended position and a retracted position, and a lever arm pivotably coupled to the post and to the plunger;

coupling the base plate to the combustor casing;

pivoting the lever arm in a first direction to slide the plunger within the brushing plate aperture relative to the post and into contact with the telescoping tube and into the extended position to decouple the telescoping tube from the liner;

locking the lever arm after the plunger is in the extended position;

inserting a retaining clip into an annular plenum defined between the liner and a combustor casing such that a notch defined by the retaining clip receives the telescoping tube to retain the telescoping tube in a decoupled position; and coupling the retaining clip to the combustor casing.

14. The method of claim 13, further comprising:

unlocking the lever arm after coupling the retaining clip to the combustor casing.

15. The method of claim 14, further comprising:

pivoting the lever arm in a second direction to slide the plunger into a retracted position after unlocking the lever arm.

16. The method of claim 15, further comprising:

decoupling the plunger assembly from the combustor casing and removing the plunger assembly from the combustion chamber after sliding the plunger into the retracted position.

17. The method of claim 16, further comprising:

removing the liner from the combustor.

18. The method of claim 13, wherein locking the lever arm comprises inserting a pin into a pin block aperture defined by a pin block coupled to the base plate and into a lever arm aperture defined by the lever arm.

19. The method of claim 13, further comprising:

removing a head end of the combustor before inserting the plunger assembly partially into the combustion chamber.

20. The method of claim 13, further comprising:

pivoting the lever arm in a second direction to slide the plunger into a retracted position before inserting the plunger assembly partially into the combustion chamber.

* * * * *